US011235367B2

(12) United States Patent
Gotthelf et al.

(10) Patent No.: US 11,235,367 B2
(45) Date of Patent: Feb. 1, 2022

(54) METHOD AND TOOL FOR CALIBRATION OF A HOLLOW PROFILE COMPONENT PRODUCED BY EXTRUSION FOR AUTOMOBILE MANUFACTURING

(71) Applicants: AUDI AG, Ingolstadt (DE); Benteler Automobiltechnik GmbH, Paderborn (DE)

(72) Inventors: Matthias Gotthelf, Neudenau (DE); Esref Ciklakarsli, Bad Friedrichshall (DE); Erik Povl Marcussen, Tønder (DK)

(73) Assignees: AUDI AG, Ingolstadt (DE); BENTELER AUTOMOBILTECHNIK GMBH, Paderborn (DE)

( * ) Notice: Subject to any disclaimer, the term of this patent is extended or adjusted under 35 U.S.C. 154(b) by 106 days.

(21) Appl. No.: 16/128,732

(22) Filed: Sep. 12, 2018

(65) Prior Publication Data

US 2019/0091745 A1 Mar. 28, 2019

(30) Foreign Application Priority Data

Sep. 22, 2017 (DE) ..... 102017008907.8

(51) Int. Cl.
*B21D 41/04* (2006.01)
*B21C 23/08* (2006.01)
(Continued)

(52) U.S. Cl.
CPC ..... *B21C 23/085* (2013.01); *B21C 23/002* (2013.01); *B21C 37/158* (2013.01);
(Continued)

(58) Field of Classification Search
CPC ..... B21D 41/04; B21D 53/88; B21D 39/04; B21D 9/04; B21D 41/02; B21D 41/026;
(Continued)

(56) References Cited

U.S. PATENT DOCUMENTS 6,287,102 B1 9/2001 Franz et al.
9,370,811 B2 6/2016 Luckey, Jr. et al.
(Continued)

FOREIGN PATENT DOCUMENTS

CN 101648236 A 2/2010
CN 201799527 U * 4/2011
(Continued)

OTHER PUBLICATIONS

American Aluminum Extrusion Company LLC, "Rectangle Tube", Dec. 2, 2016, American Aluminum Extrusion, https://web.archive.org/web/20161202083926/http://www.americanaluminum.com/standard-extrusion/rectangle-tube/(Year: 2016).*
(Continued)

*Primary Examiner* — Debra M Sullivan
*Assistant Examiner* — Dylan Schommer
(74) *Attorney, Agent, or Firm* — Maier & Maier, PLLC

(57) ABSTRACT

A method for the calibration or end sizing of a hollow profile component produced by extrusion for automobile manufacturing. The hollow profile component is inserted into the cavity of an opened press tool and closing the press tool. Expandable mandrels are introduced into the open profile ends of the hollow profile component. The hollow profile component is calibrated or end-sized by applying force simultaneously on the outside and on the inside. The expandable mandrels are retracted, opening of the press tool, and removing of the hollow profile component.

10 Claims, 1 Drawing Sheet

(51) Int. Cl.

| | |
|---|---|
| ***B21C 37/15*** | (2006.01) |
| ***B21C 37/30*** | (2006.01) |
| ***B21D 37/10*** | (2006.01) |
| ***B21D 22/02*** | (2006.01) |
| ***B21C 23/00*** | (2006.01) |
| ***B21D 53/88*** | (2006.01) |

(52) U.S. Cl.
CPC ..... *B21C 37/30* (2013.01); *B21D 22/025* (2013.01); *B21D 37/10* (2013.01); *B21D 41/04* (2013.01); *B21D 53/88* (2013.01)

(58) Field of Classification Search
CPC ..... B21D 41/028; B21D 37/10; B21D 9/05; B21D 19/10; B21D 19/06; B21D 22/025; B21C 23/085; B21C 23/002; B21C 37/158; B21C 37/30
USPC ..... 72/264
See application file for complete search history.

(56) References Cited

U.S. PATENT DOCUMENTS

| | | | | |
|---|---|---|---|---|
| 2010/0024503 | A1* | 2/2010 | Bradley | B21D 26/14 72/61 |
| 2010/0295296 | A1* | 11/2010 | Kawamata | B21D 41/026 285/382.5 |
| 2017/0341119 | A1* | 11/2017 | Toguyeni | F16L 9/02 |

FOREIGN PATENT DOCUMENTS

| | | | | |
|---|---|---|---|---|
| CN | 201799527 | U | 4/2011 | |
| CN | 104259319 | A | 1/2015 | |
| CN | 105268856 | A | 1/2016 | |
| CN | 205763080 | U | 12/2016 | |
| CN | 106541036 | A | 3/2017 | |
| DE | 2016201 | A1 * | 10/1971 | B21D 39/04 |
| DE | 3816090 | C2 | 5/1993 | |
| DE | 19930015 | A1 | 1/2001 | |
| DE | 102004040617 | A1 | 3/2006 | |
| DE | 10 2015 212 968 | A1 | 1/2016 | |
| EP | 0879132 | B1 | 10/2001 | |
| EP | 1285705 | A2 | 2/2003 | |
| EP | 1534443 | B1 | 3/2006 | |
| JP | S57-981 | Y2 | 1/1982 | |
| SU | 841729 | A1 | 6/1981 | |

OTHER PUBLICATIONS

Examination Report dated Aug. 3, 2018 of corresponding German Application No. 102017008907.8; 10 pgs.

Chinese Office Action dated Dec. 31, 2019, in connection with corresponding CN Application No. 201811107195.4 (21 pgs., including machine-generated English translation).

Office Action dated Feb. 3, 2021 in corresponding Chinese Application No. 201811107195.4; 22 pages including English-language translation.

* cited by examiner

METHOD AND TOOL FOR CALIBRATION OF A HOLLOW PROFILE COMPONENT PRODUCED BY EXTRUSION FOR AUTOMOBILE MANUFACTURING

FIELD

The invention relates to a method and tool for calibration or end sizing of a hollow profile component produced by extrusion for automobile manufacturing.

The invention further relates to a method for producing a hollow profile component for automobile manufacturing.

BACKGROUND

Hollow profile sections or hollow chamber profiles used in the manufacture of automobiles or vehicles may be produced by extrusion. An extrusion production is especially suited to aluminum profiles. However, extruded hollow profile sections usually have dimension and shape deviations, so that a calibration or an end sizing process may be needed to maintain tolerance requirements prior to further processing.

EP 1 534 443 B1 describes a method for producing structural components from an extruded profile section, especially one made of aluminum, e.g., in the field of automobile manufacture. In order to achieve especially high precision in terms of the dimensions of the profile cross section while at the same time lowering costs, it is proposed to subject the extruded profile sections separated from the hot strand to a hot forming process while maintaining the heat. The hot forming process is designed in particular as a hydroforming (IHU), a forging or an embossing and may also involve an end sizing step.

U.S. Pat. No. 9,370,811 B2 describes an end sizing of a straight extruded pipe for vehicle construction. The extruded pipe for this purpose is arranged with a slight gap in the cavity of a stretch sizing tool. Clamps are arranged at the ends, which then stretch the pipe in the longitudinal direction between, e.g., 1% and 4%, and in this way, straighten it out so that warping and other deformations are reduced or eliminated.

The object of the invention is to indicate another possibility for the calibration or end sizing of extruded hollow profile components that does not have, or at least has only to a lesser extent, at least one of the drawbacks involved in the prior art.

The object is achieved by a method and by a press tool (device). The invention also extends to a method for the production of a hollow profile component for automobile manufacturing.

SUMMARY

The method according to the invention compresses at least the following steps:

- inserting the hollow profile component (being calibrated) into the cavity of an opened press tool and closing the press tool, so that the hollow profile component is taken up in the cavity preferably at least at one of its end regions, outside its open profile end, and, especially entirely outside its open profile ends;
- introducing or inserting of widening or expandable mandrels into the (two) open profile ends of the hollow profile component;

- calibrating the hollow profile component by applying pressure or force simultaneously on the outside and on the inside;
- retracting or removing of the expandable mandrels, opening of the press tool, and removing the (calibrated) hollow profile component.

The closing of the press tool and the introducing of the expandable mandrels may be carried out in succession or also substantially at the same time. The retracting of the expandable mandrels and the opening of the press tool may also be conducted in succession or substantially at the same time. The application of force from the outside is carried out, in particular, by the parts of the press tool forming the cavity, the press tool particularly being a press tool according to the invention, while the application of force from the inside is conducted by the expandable mandrels.

A hollow profile component or hollow chamber profile component in the sense of the invention is a tubular structural component intended for installation in a motor vehicle or as a component of the bodywork or as a component of the chassis, having at least one hollow chamber extending in the longitudinal or axial direction (single-chamber or multiple-chamber profile). The hollow profile component is produced by extrusion forming and is, in particular, an extruded piece of definite axial length, which is separated from an extruded strand.

An expandable mandrel is a spike-shaped device which is introduced into the interior of the hollow profile component and can then be widened transversely, especially perpendicularly to the direction of insertion. Thus, such a mandrel has at least two reversible states, namely, a first state with non-expanded cross section (in this state, the mandrel can be introduced into the hollow profile section) and a second state with expanded cross section (for the internal application of force or pressure after being introduced). The mandrel, in particular, has multiple pieces (see below) and may therefore also be called a mandrel set. The mandrels or mandrel sets used may be formed differently.

By calibration or end sizing is meant the process of end sizing (calibrating process) in order to eliminate dimensional and shape deviations entirely or for the most part, wherein the hollow profile component, due to the application of forming forces is transformed such that it subsequently has the tolerances necessary for installation in the vehicle.

With the invention, very good calibration results with close forming tolerances can be achieved (dimensional deviations of <0.5 mm). Moreover, the invention makes possible short cycle times and works without operating media, unlike IHU end sizing.

Furthermore, the invention is suited not only to straight, but also curved or arc-shaped hollow profile components. The invention also has yet other advantages.

Preferably, the (two) expandable mandrels are mechanically activated via double V-slide mechanisms. In particular, it is provided that the mandrels are widened with the aid of first wedges, while the first wedges are activated with the aid of second wedges. This shall be explained more closely below.

The hollow profile component may be calibrated over its entire axial length, given appropriate design of the expandable mandrels. Likewise, it can be provided that the hollow profile component is calibrated only locally in the end regions (or optionally also only in one of the end regions), which can also be called a partial calibration or partial end sizing. The end regions preferably have an axial length (starting from the open profile ends) of 50 mm to 150 mm and especially around 100 mm. The end sizing of the end regions may be perfectly adequate, e.g., for a casting node attachment. Moreover, the end sizing of the end regions is also possible for a curved or arc-shaped hollow profile component. Furthermore, the cycle time is shorter on account of the small mandrel movements.

During the calibration, at least one functional geometry may also be formed in the hollow profile component, especially in at least one of the end regions. A functional geometry is, e.g., a local reinforcement bead or a local indentation or embossing for a joining element.

Moreover, it may be provided that during the calibration, the cross section of the hollow profile component is scaled with a scaling factor of <1, optionally only in the end regions. By this is meant that the overall cross section is reduced in size. However, a scaling may also be undertaken only in the closing direction of the press tool (height direction of the component) or transversely to the closing direction (width direction of the component). Preferably, a scaling factor of 0.99 to 0.95 is used, wherein a size reduction by at least 1.0 mm is accomplished, especially in the component height direction and/or in the component width direction. Thanks to the scaling (size reduction), the hollow profile component is plastically deformed during the calibration, wherein dimensional and shape deviations are eliminated or at least reduced. Optimal scaling factors can be determined virtually by means of simulation.

The hollow profile component is preferably formed from (extruded) aluminum. The material used is preferably an aluminum alloy of the 6000 alloy group (aluminum-magnesium-silicon alloys), which can be converted especially by hot aging to a T6 state (hot cured or hot aged). However, the invention also makes possible a calibration or an end sizing in an already cold cured state (T4) or hot cured state (T6).

The press tool according to the invention makes possible the simultaneous application of force from the outside and the inside to the hollow profile component being calibrated. For this, the press tool according to the invention is designed with:

- a bottom tool piece (such as a bottom die) and a top tool piece (such as a top die or a punch), which tool pieces can move relative to each other and which comprise (at least) one cavity for uptake of the hollow profile component;
- two widening or expandable mandrels, which can be introduced in the longitudinal direction into the open profile ends of the hollow profile component accommodated in the cavity and then expanded or widened, especially transversely to the longitudinal direction.

Analogously to the preceding explanations, the press tool according to the invention can be designed and configured to calibrate only the end regions, or at least one of the end regions, of a hollow profile component.

The press tool according to the invention is installed, in particular, in a conventional forming press or the like (press-bound tool apparatus), wherein the bottom tool part is arranged on the press bench and the top tool part can be attached to the press ram.

The bottom tool part is preferably designed as a die, especially with a groove-shaped cavity, and the top tool part is designed as a punch.

The cavity may be configured such that at least one of the end regions of the hollow profile component, preferably both of the end regions, are taken up and surrounded by the cavity wall and, in particular, the hollow profile component can be completely taken up, although the open profile ends remain accessible to the expandable mandrels.

Each of the expandable mandrels may comprise at least two jaws, which can be forced apart by means of a first wedge that can be pushed between them. Preferably, the first wedges that can be pushed between the jaws can be activated by means of second wedges (double V-slide mechanism).

A first method for producing a hollow profile component for automobile manufacturing may comprise the following steps:

- producing or creating a hollow profile by extrusion and optionally by reforming (such as bending) of the extruded strand (directly during the extrusion), wherein the hollow profile section is formed in particular from aluminum, which is extruded at a temperature of >500° C. and is then quenched (so that dimensional and shape deviations may occur);
- creating the hollow profile component by separating (e.g., sawing off) a piece from the extruded hollow profile section or extruded strand (it is also possible to first form an intermediate blank from the extruded strand and the extruded piece can be separate from it);
- optional reforming (e.g., bending or hydroforming) of the hollow profile component or of the extruded piece;
- calibration or end sizing of the hollow profile component or extruded piece with the method according to the invention and/or the press tool according to the invention, including optional forming of at least one functional geometry in it;
- optional mechanical processing or machining (e.g., final trimming, milling, boring, grinding, etc.) of the hollow profile component or extruded piece;
- optional hot curing (hot aging) of the calibrated hollow profile component (in particular, in this process, the T6 state is reached).

A second method for especially economical production of a hollow profile component for automobile manufacturing may comprise the following steps:

- producing or creating a hollow profile, particularly formed from aluminum, by extrusion and optionally by reforming (such as bending) of the extruded strand (directly during the extrusion);
- creating the hollow profile component by separating (e.g., sawing off) a piece from the extruded hollow profile or extruded strand (it is also possible to first form an intermediate blank from the extruded strand and the extruded piece can be separated from it);
- optional reforming (e.g., bending or hydroforming) and/or preliminary calibration (optionally also by IHU) of the hollow profile component or extruded piece;
- hot curing (hot aging) of the hollow profile component or extruded piece (in particular, the T6 state is reached in this process);
- calibration or end sizing of the hot cured or hot aged hollow profile component or extruded piece with the method according to the invention and/or the press tool according to the invention, including optional forming of at least one functional geometry;
- optional mechanical processing or machining (e.g., final trimming, milling, boring, grinding, etc.) of the hot cured hollow profile component or extruded piece.

In the second method, the hot aging does not occur, as is usual, at the end of the manufacturing, so that, among other things, cost benefits result. The second method is especially suited to the advantageous production of straight hollow profile components.

The hollow profile component produced in this way can then be installed, e.g., as a longitudinal beam, door sill, brace or the like, in an automobile or motor vehicle being manufactured or repaired.

BRIEF DESCRIPTION OF DRAWINGS

The invention shall now be explained more closely with reference to the drawing. The features shown in the figures of the drawing and/or explained below may be general features of the invention and enhance the invention accordingly, even independently from defined feature combinations.

DETAILED DESCRIPTION

Figure 1:
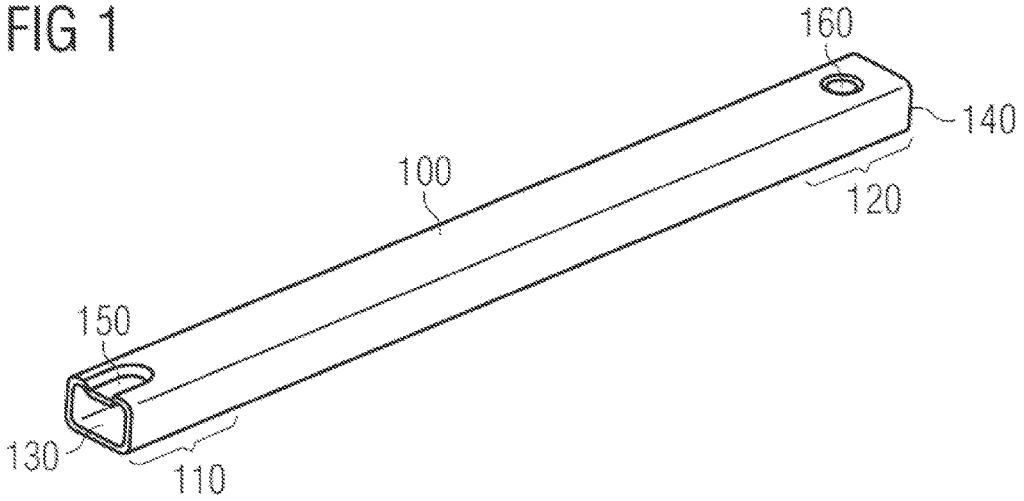
FIG. 1 shows a hollow profile component in a perspective view.

The hollow profile component 100 shown in FIG. 1 is formed from an extruded aluminum rectangular profile. The hollow profile component 100 may have an axial length of, e.g., 1000 mm and it may be installed as a longitudinal or transverse beam in an automobile, e.g., as part of a spaceframe bodywork structure. Because of the extruded production, the hollow profile component 100 may have dimensional and shape deviations, e.g., in the form of warping or buckling, so that prior to installing it, especially in regard to the joining technologies used, a calibration or an end sizing is required.

Figure 2:
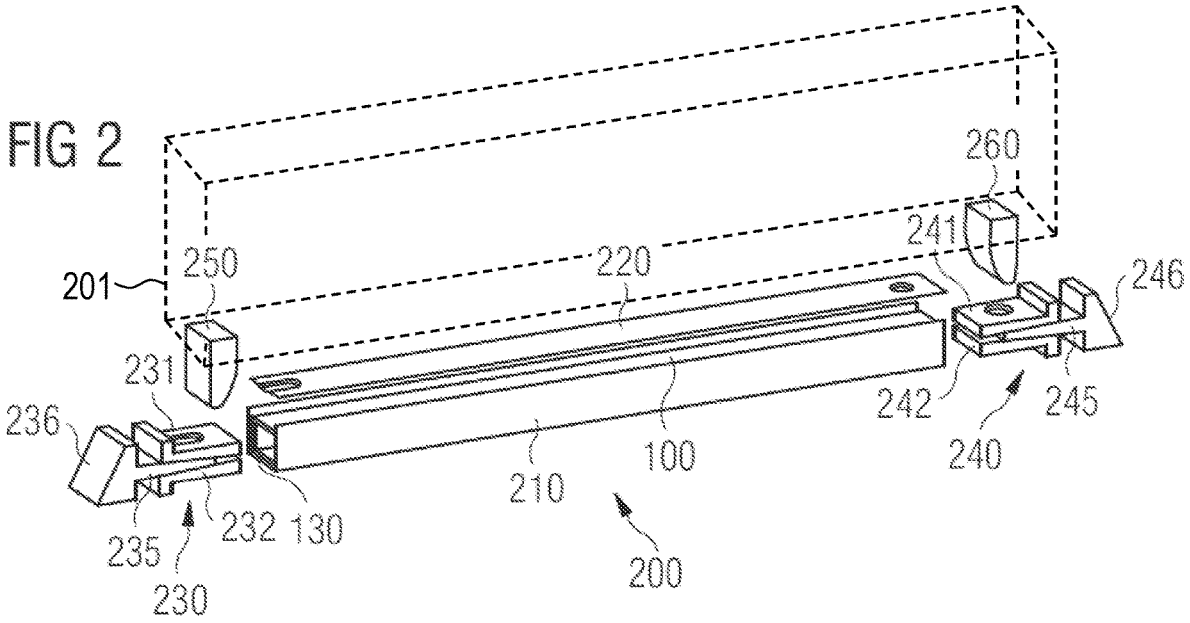
FIG. 2 illustrates schematically in a perspective representation the calibration or end sizing of the hollow profile component of FIG. 1.

FIG. 2 shows a press tool 200 according to the invention for the calibration of the hollow profile component 100. The press tool 200 installed in a forming press comprises a bottom tool part 210 fashioned as a die, of which only the operative tool surface is shown, and a top tool part 220 fashioned as a punch, of which likewise only the operative tool surface is shown. The design configuration of the die 210 and the punch 220 lies within the competence of the person skilled in the art. Moreover, the press tool 200 includes two expandable mandrels or mandrel sets 230 and 240.

For the calibration, the hollow profile component 100 is inserted into the die 210 of the press tool 200, as shown in FIG. 2. By lowering the punch 220, the press tool 200 is closed, so that the hollow profile component 100 is totally enclosed by the tool cavity, except at its open profile ends 130 and 140. The expandable mandrels 230 and 240 are introduced into the open profile ends 130 and 140 of the hollow profile component 100. By external application of force by means of the punch 220 and by simultaneous internal application of force by means of the expandable mandrels 230 and 240 (which are expanded for this purpose), the hollow profile component 100 is calibrated in its two end regions 110 and 120, determined by the insertion lengths of the mandrels 230 and 240 (for example, 100 mm). The functional geometries 150 and 160 may also be formed in this process. The end sizing and the forming of the functional geometries 150 and 160 occurs in the cold state within a single press stroke. After the expandable mandrels 230 and 240 have been returned to a non-expanded state and retracted from the hollow profile component 100, the press tool 200 can be opened and the calibrated hollow profile component 100 can be removed and further processed.

The bottom tool part 210 and the top tool part 220 form a kind of external tool for the applying of external shaping forces and the two expandable mandrels 230 and 240 form a kind of internal tool for the simultaneous applying of internal shaping forces. The external tool 210/220 and the internal tools 230/240 are coordinated with each other such that the nominal geometry of the hollow profile component 100 can be formed with them. The internal cross sections of the external tool 210/220 and the external cross sections of the internal tools 230/240 are, for example, coordinated with each other such that the respective gap between introduced expanded internal tool 230/240 and external tool 210/220 corresponds to the respective nominal profile of the hollow profile component 100.

The mandrels 230 and 240 each comprise two mandrel jaws 231 and 232 as well as 241 and 242, configured here as top and bottom mandrel jaws 231/232 or 241/242 and able to be forced apart transversely to the longitudinal or axial direction of the hollow profile component 100 with the aid of a first wedge 235 or 245, which can be pushed between them in the longitudinal or axial direction. The first wedges 235 and 245 are activated via exterior sloping surfaces 236 and 246 by means of second wedges 250 and 260, which are coupled, in particular, with the top tool part 220 or the press ram 201. The double V-slide mechanisms make possible a very good adapting of the force and displacement transmission, so that the press tool 200 can also be used in forming presses with slight pressing force. The jaws and wedges are preferably made of a steel material, especially a hardened steel material. The resetting can be conducted by means of spring elements, not shown.

The invention claimed is:

1. A method for the calibration or end sizing of a hollow profile component produced by extrusion for automobile manufacturing, comprising the steps:

inserting the hollow profile component into a bottom tool part of an opened press tool and closing the press tool by lowering a top tool part of the press tool;

introducing expandable mandrels into the open profile ends of the hollow profile component;

calibrating or end sizing of the hollow profile component by use of a press ram traversing a height direction of the hollow profile component to simultaneously apply force to both the top tool part and the expandable mandrels, such that the hollow profile component is plastically deformed as a result of:

exertion of an external force upon the hollow profile component by the top tool part and the bottom tool part; and expansion of the expandable mandrels transversely to a longitudinal direction of the hollow profile component in response to the force applied by the press ram, the expansion exerting an internal force upon the hollow profile component, and retracting the expandable mandrels, opening the press tool by raising the top tool part, and removing the hollow profile component.

2. The method as claimed in claim 1, wherein the expandable mandrels each comprise at least two mandrel jaws, a first wedge, and a second wedge, wherein the at least two mandrel jaws are forced apart via the first wedge, which is configured to move axially with respect to the hollow profile component being calibrated or end sized, wherein the first wedge is actuated by the second wedge, which acts upon a sloped surface of the first wedge, and wherein the second wedge is coupled to and acted upon by the press ram either directly or via the top tool part.

3. The method as claimed in claim 1, wherein only the end regions of the hollow profile component are calibrated or end sized.

4. The method as claimed in claim 3, wherein during the calibration, functional geometries are also formed in the hollow profile component.

5. The method as claimed in claim 1, wherein during the calibration, the cross section of the hollow profile component is scaled with a scaling factor of <1.

6. A press tool for the calibration or end sizing of an extruded hollow profile component for automobile manufacture, comprising:

a bottom tool part and a top tool part, which are configured to move relatively to each other and which have a cavity for taking up the hollow profile component;

two expandable mandrels, which are configured to be introduced into open profile ends of the hollow profile component taken up in the cavity; and a press ram, which is configured to traverse a height direction of the hollow profile component and which acts upon both the top tool part and the two expandable mandrels, simultaneously distributing force to both the top tool part and the two expandable mandrels, wherein the top tool part and the bottom tool part are further configured to exert an external force upon the hollow profile component in response to force applied by the press ram, and wherein the two expandable mandrels are further configured to expand transversely to a longitudinal direction of the hollow profile component in response to force applied by the press ram, thereby exerting an internal force upon the hollow profile component.

7. The press tool as claimed in claim 6, wherein the expandable mandrels each comprise a first wedge and at least two jaws, and wherein the at least two jaws are configured to be forced apart from one another by pushing the first wedge between the at least two jaws.

8. The press tool as claimed in claim 7, wherein the expandable mandrels each further comprise a second wedge, which acts upon a sloped surface of the first wedge to push the first wedge between the at least two jaws, wherein the second wedges are each coupled to and acted upon by the press ram either directly or via the top tool part.

9. The press tool as claimed in claim 6, wherein the bottom tool part is designed as a die and the top tool part as a punch.

10. A method for producing a hollow profile component for automobile manufacturing, comprising the steps:

creating a hollow profile by extrusion;

creating the hollow profile component by separating a piece from the hollow profile; and calibrating or end sizing the hollow profile component using the method according to claim 1.

* * * * *